US005776085A

United States Patent [19]

Stone et al.

[11] Patent Number: 5,776,085

[45] Date of Patent: Jul. 7, 1998

[54] APPARATUS FOR ATTACHING A MASSAGING MACHINE TO A SUPPORT MEMBER

[76] Inventors: Leonard J. Stone, 5400 Park Ave. #408, Memphis, Tenn. 38119; Philip Kantor, 5661 Shady Glen, Memphis, Tenn. 38120

[21] Appl. No.: 715,102

[22] Filed: Sep. 18, 1996

[51] Int. Cl.[6] ..... A61H 1/00

[52] U.S. Cl. ..... 601/99; 601/26; 128/781

[58] Field of Search ..... 602/59, 56, 57, 602/58; 297/284.7; 601/97–99, 116, 59, 26; 446/137, 129; 128/781

[56] References Cited

U.S. PATENT DOCUMENTS

| | | | |
|---|---|---|---|
| 2,060,298 | 11/1936 | Gailey | 297/284.7 |
| 2,345,439 | 3/1944 | Tompkins . | |
| 3,279,849 | 10/1966 | Radke et al. | 297/284.7 |
| 3,322,116 | 5/1967 | Murphy et al. . | |
| 3,405,709 | 10/1968 | Mathers . | |
| 3,811,430 | 5/1974 | Kawakami . | |
| 4,006,739 | 2/1977 | Wahl . | |
| 4,097,087 | 6/1978 | Garavaglia | 297/284.7 |
| 4,634,176 | 1/1987 | Scott | 297/284.7 |
| 5,188,096 | 2/1993 | Yoo . | |
| 5,374,238 | 12/1994 | Xiao | 601/57 |
| 5,624,158 | 4/1997 | Adat et al. | 297/284.7 |

*Primary Examiner*—Jerome W. Donnelly
*Attorney, Agent, or Firm*—Walker, McKenzie & Walker, P.C.

[57] ABSTRACT

An apparatus for mounting a portable massaging machine to a support member such as a chair or the like. The apparatus includes a backboard member for attachment to the support member; and securing structure for adjustably securing the portable massaging machine to the backboard member.

11 Claims, 4 Drawing Sheets

APPARATUS FOR ATTACHING A MASSAGING MACHINE TO A SUPPORT MEMBER

BACKGROUND OF THE INVENTION

1. Field of the Invention

The present invention relates, in general, to an apparatus for adjustably and removably attaching a massaging machine to a support member such as a chair to enable a user to control the position of the massaging machine so it can be directed to very specific areas of the spine, neck, and other body parts.

2. Information Disclosure Statement

A preliminary patentability search conducted in class 601, subclasses 86, 90, 115, 146, 116, 66, 52 and 57 produced the following patents which appear to be relevant to the present invention:

Tompkins, U.S. Pat. No. 2,345,439, issued Mar. 28, 1944, discloses a therapeutic device adapted to be attached to a standard bed frame in a position over a mattress so that gyratory oscillations may be imparted to a person reposing on the mattress and abutting the device. The device includes a pair of plates for clamping a portion of the bed frame therebetween, and a parallelogram-type linkage extending between the plates and housing having a vibrating face surface or the like for abutting a person's back, etc.

Murphy et al., U.S. Pat. No. 3,322,116, issued May 30, 1967, discloses a vibratory massage apparatus adapted to be installed in a chair or table, etc. The massage apparatus includes a track, a carriage mounted on the track, a plurality of massage rollers, a pair of outwardly bowed spring members connecting the massage rollers to the carriage, and vibration means for vibrating the rollers and springs.

Mathers, U.S. Pat. No. 3,405,709, issued Oct. 15, 1968, discloses a massage assembly adapted for reciprocating travel within a cushioned framework such as a chair backrest or massage table. The massage assembly includes a carriage baseframe, a pair of arched springs arranged in parallel relation and extending longitudinally of the baseframe with the ends thereof secured to the baseframe, and a vibration producing unit mounted to a suspension bar extending between and attached to the arched springs.

Kawakami, U.S. Pat. No. 3,811,430, issued May 21, 1974, discloses a portable massaging device including a motor, a pair of eccentrically rotatable vibrator elements for producing vibrations through a housing structure, and a plurality of coil springs for amplifying the vibration. The motor, vibrator elements and housing structure are covered with sponge material to enable the device to be used as a cushion.

Wahl, U.S. Pat. No. 4,006,739, issued Feb. 8, 1977, discloses a portable cushion including back padding, front padding, a rigid or semi-rigid frame member between the front and back padding, and a vibratory mechanism contained in a casing which is located in the lower portion of the frame member. The position of the casing is such that when the cushion is placed next to the back of a chair with its lower end resting on the seat of the chair, the casing will be approximately even with the lumbar region of an adult sitting in the chair.

Yoo, U.S. Pat. No. 5,188,096, issued Feb. 23, 1993, discloses a massage apparatus including a mat having a plurality of massage cells arranged in each of several lateral and vertical rows and adapted to be vibrated individually, and a control device that allows the massage area, massage intensity and operating time to be changed.

Portable massaging machines such as, for example, "The Masseur"™ model CN-168M portable massager sold by K-Tel International (USA) Inc., are designed to be hand held by the person receiving treatment or another person giving treatment, and generally include a housing having a pair of handles on opposite sides thereof and a face surface with massaging fingers or the like extending therefrom for engaging and massaging (i.e., kneading and/or vibrating) a portion of a person's body.

Nothing in the known prior art discloses or suggests the present invention. More specifically, nothing in the known prior art discloses or suggests an apparatus for mounting a portable massaging machine to a support member such as a chair or the like, the apparatus including a backboard member for attachment to the support member; and securing means for securing the portable massaging machine to the backboard member.

SUMMARY OF THE INVENTION

The present invention provides structure for attaching a portable massaging machine to a chair or the like. The present invention relates to an accessory for a portable massaging machine that enables the user to control the position of the portable massaging machine so it can be directed to very specific areas of the user's spine, neck, and other body parts. A basic concept of the present invention is to provide first means for being attached to a chair or the like, and second means for being attached to the portable massaging machine and for being movably and removably attached to the first means.

The apparatus of the present invention includes, in general, a backboard member for attachment to the support member; and securing means for securing the portable massaging machine to the backboard member.

One object of the present invention is to provide an accessory for a typical portable massaging machine that frees the user from holding the massaging machine or from the help of another person.

Another object of the present invention is to provide such an accessory that enables the user to direct the kneading or vibrating action of the massaging machine to individual vertebrae of the spine from the lumbar or lower level to the neck.

Another object of the present invention is to provide such an accessory that enables the user to control the intensity of the treatment by varying his or her own body pressure to produce the most efficient and comfortable effect.

DESCRIPTION OF THE PREFERRED EMBODIMENT

Figure 1:
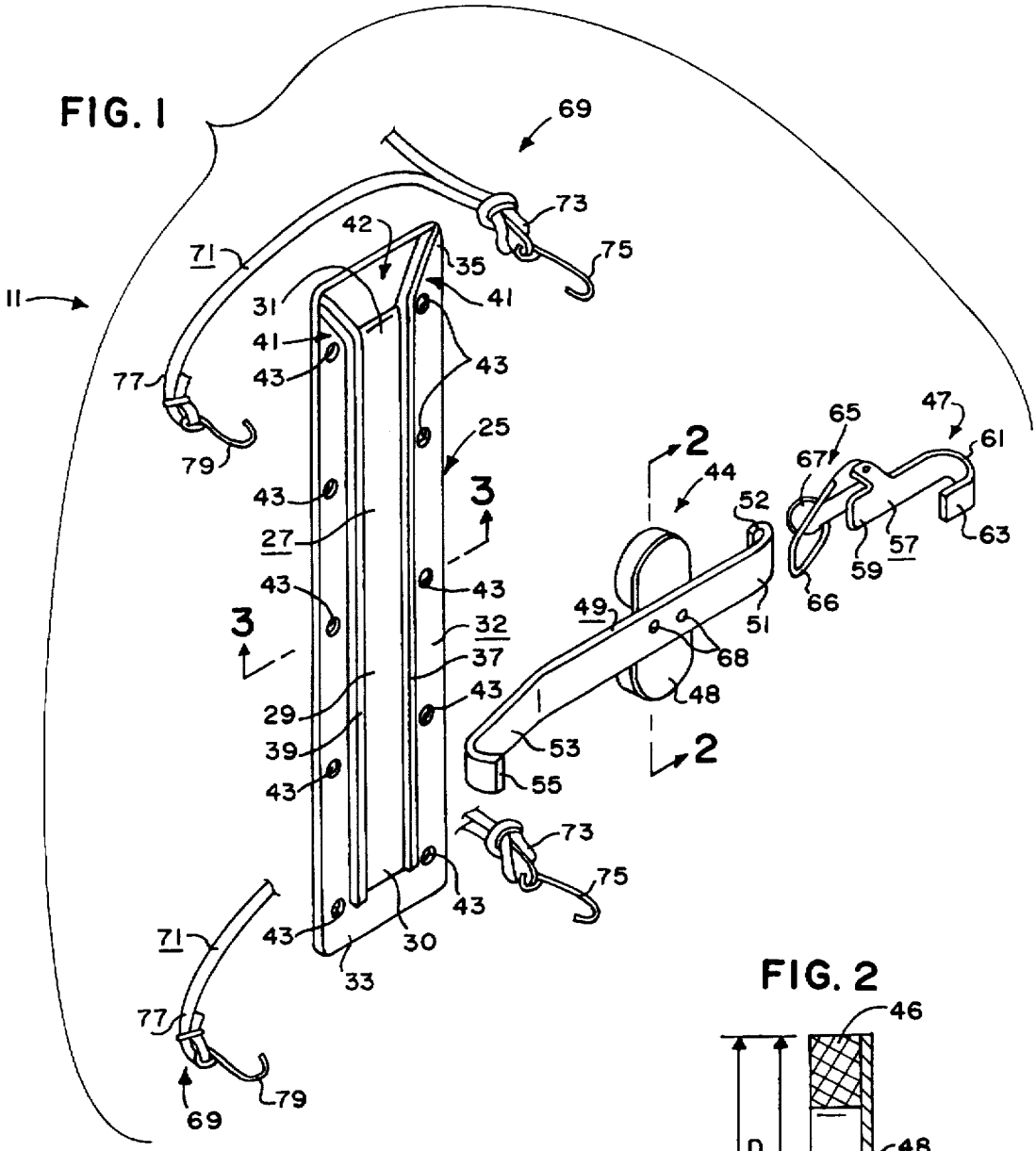
FIG. 1 is an exploded perspective view of the apparatus of the present invention.

A preferred embodiment of the apparatus of the present invention is shown in FIGS. 1–9, and identified by the numeral 11. The apparatus 11 is specifically designed for mounting a portable massaging machine M to a support member, such as a standard straight-back chair C (see FIG. 4), a typical secretarial-type chair S (see FIG. 6), or the like.

The massaging machine M may consist of any typical, off-the-shelf portable massaging machine such as, for example, "The Masseur"™ model CN-168M portable massager sold by K-Tel International (USA) Inc., of 15535 Medina Rd., Plymouth, Minn. 55447, designed to be hand held by the person receiving treatment or another person giving treatment, and generally including a housing 13 having a handle 15 on each side thereof, a back surface 16, and a face surface 17 with massaging fingers 19 or the like extending therefrom for engaging and massaging (e.g., kneading and/or vibrating) a portion of a person's body. (see FIG. 5).

Figure 4:
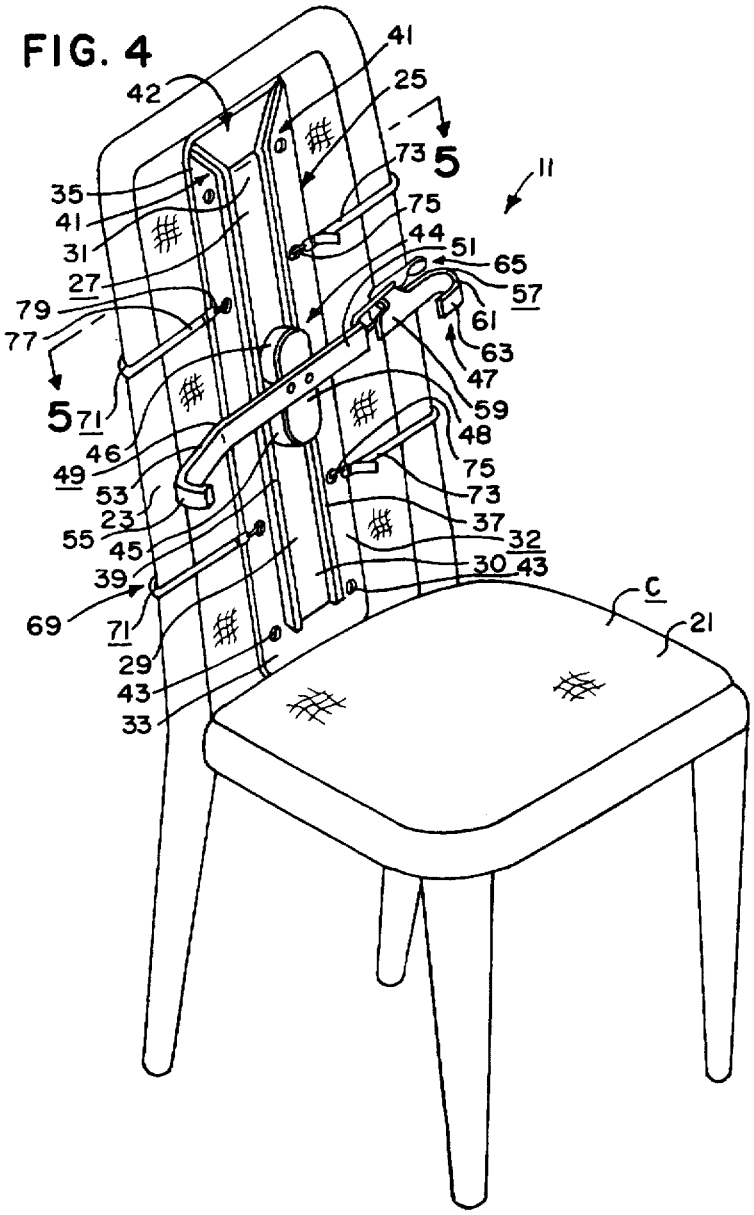
FIG. 4 is a perspective view of the present invention, shown combined with a chair having a standard backrest portion.
Figure 5:
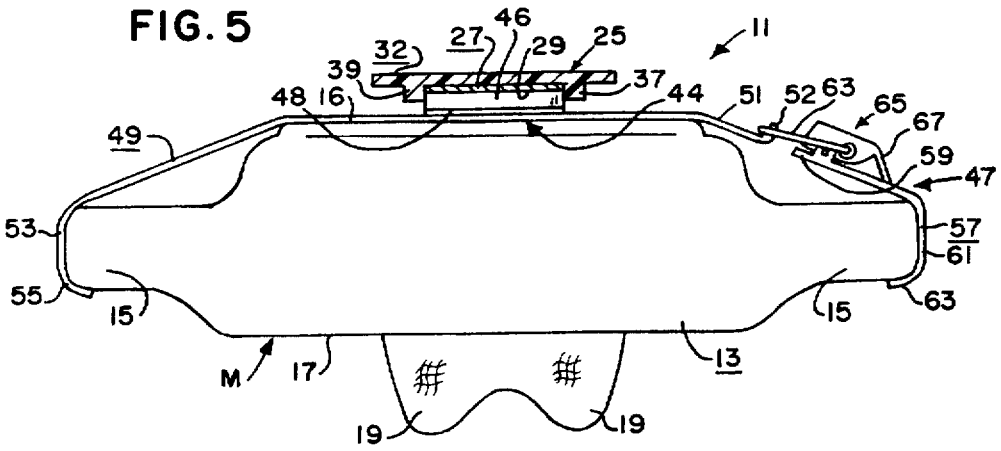
FIG. 5 is a sectional view substantially as taken on line 5—5 of FIG. 4 on an enlarged scale, with portions omitted for clarity, and shown combined with a portable massaging machine.

While the support member may consist of any structure used to support at least a portion of a person's body such as a straight chair, an armchair, a recliner, a rocking chair, a folding chair, a stool, a sofa, a bed, an exercise machine, etc., it preferably consists of a standard chair C having a seat or seat portion 21 and preferably having a back or back portion 23 (see FIG. 4).

The apparatus 11 includes a body or backboard member 25 for attachment relative to the support member, e.g., to the back portion 23 of the chair C. The body member 25 has a magnetic member or portion 27 (i.e., a member or portion that is capable of being magnetized or attracted by a magnet). The magnetic portion 27 has a face surface 29, a first or lower end 30 and a second or upper end 31. The second or upper end 31 is preferably bevelled as clearly shown in FIG. 9.

The body member 25 preferably includes an elongated, rigid base portion or member 32 having a first or lower end 33 and a second or upper end 35. The base member 32 preferably has a first track or ridge member 37 extending generally between the first and second ends 33, 35 thereof; and a second track or ridge member 39 extending generally between the first and second ends 33, 35 thereof and spaced from the first track member 37 a sufficient distance to allow the magnetic portion 27 to be positioned between the first and second track members 37, 39. The first and second track members 37, 39 are preferably parallel to one another from the first end 33 of the base member 32 to an intermediate point 41 a relatively short distance below the second end 35 of the base member 32, and preferably diverge from one another from that intermediate point 41 of the base member 32 to the second end 35 of the base member 32 to form an enlarged mouth 42, as clearly shown in FIGS. 1, 4, 6 and 8. The base member 32 preferably has a plurality of spaced apart apertures 43 therethrough adjacent each side thereof for reasons which will hereinafter become apparent.

The base member 32 may be constructed in various manners, out of various materials, in various shapes and sizes, etc. Thus, for example, the base member 32 is preferably molded, cast, or otherwise constructed as a one-piece, integral unit out of a strong, rigid plastic, etc., as will now be apparent to those skilled in the art.

The magnetic portion 27 of the body member 25 preferably consists of a metal backboard constructed from a flat piece of iron, steel or other metal to which magnets are attracted. The magnetic portion 27 is preferably cemented or otherwise fixedly and securely attached to the base member 32 between the first and second track members 37, 39. The magnetic portion 27 is preferably sized to extend from the first end 33 of the base member 32 to the intermediate point 41 of the base member 32, and between the first and second track members 37, 39.

Figure 2:
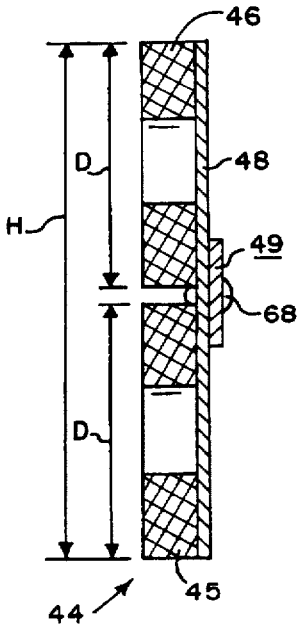
FIG. 2 is a sectional view of a portion of the present invention, substantially as taken on line 2—2 of FIG. 1 on an enlarged scale and with portions thereof omitted for clarity.
Figure 3:
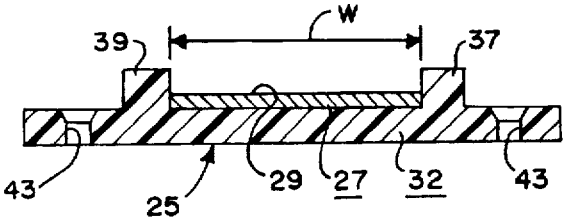
FIG. 3 is a sectional view of a portion of the present invention, substantially as taken on line 3—3 of FIG. 1 on an enlarged scale and with portions thereof omitted for clarity.

The apparatus 11 includes securing means for adjustably securing the portable massaging machine M to the body or backboard member 25. While the securing means may be of various different physical designs such as, for example, the combination of a plurality of spaced hangers attached the body or backboard member 25, and a hook attached to the portable massaging machine M for engaging the hangers, or an elongated rod attached to the body or backboard member 25, and a follower attached to the portable massaging machine M for engaging the rod, etc., the securing means preferably includes a magnet or magnetic means 44 for movable attachment to the magnetic portion 27 of the body member 25. The magnetic means 44 preferably consists of one or more off-the-shelf permanent magnets, and preferably has a width that allows the magnetic means 44 to slidably fit between the first and second track members 37, 39 and an overall height that is greater than the distance between the first and second track members 37, 39 so that the magnetic means 44 can slide lengthwise of the magnetic portion 27 but cannot fully rotate about an axis perpendicular to the face of the magnetic portion 27. Thus, as shown in FIGS. 1 and 2, the magnetic means 44 may include a ring or disk-shaped first magnet 45 and a ring or disk-shaped second magnet 46 with the diameter D of each magnet 45, 46 (see FIG. 2) slightly less than the width W between the first and second track members 37, 39 (see FIG. 3) so that the first and second magnets 45, 46 can freely slide along the magnetic portion 27 between the first and second track members 37, 39 as will now be apparent to those skilled in the art. However, the first and second magnets 45, 46 are preferably fixed relative to one another in a manner as will hereinafter be fully disclosed so that the combined height H thereof (see FIG. 2) is greater that the width W between first and second track members 37, 39 so that the magnetic means 44, as a unit, is prevented from fully rotating or twisting about an axis perpendicular to the face of the magnetic portion 27 as will now be apparent to those skilled in the art. The strength of the magnetic means 44 can vary, depending on the weight of the portable massaging machine M to be attached to the chair C, etc., as will now be apparent to those skilled in the art.

The apparatus 11 includes mounting means 47 for mounting the magnetic means 44 to the portable massaging machine M. The mounting means 47 preferably includes a harness for being buckled or otherwise fastened to the portable massaging machine M and to which the magnetic means 44 can be cemented or otherwise fixed. More specifically, the mounting means 47 preferably includes a plate 48 attached to the magnetic means 44 (e.g., the back of each magnet 45, 46 may be cemented or otherwise fixedly attached to the plate 48); a first strap 49 having a first end 51 with a hook 52 and having a second end 53 with a hook 55; a second strap 57 having a first end 59 and having a second end 61 with a hook 63; and a buckle mechanism 65 mounted relative to the first end 59 of the second strap 57 for attaching the second strap 57 to the first strap 49. The hook 55 on the second end 53 of the first strap 49 is adapted to hook onto a portion of the portable massaging machine M (e.g., for hooking onto one of the handles 15). The hook 63 on the second end 61 of the second strap 57 is adapted to hook onto a portion of the portable massaging machine M (e.g., for hooking onto another one of the handles 15). The buckle mechanism 65 preferably includes a ring 66 for hooking onto the hook 52 on the first end 51 of the first strap 49, and a lever-type handle 67 for pivotally joining the ring 66 to the first end 59 of the second strap 57 so that the effective distance between the second end 53 of the first strap 49 and the second end 61 of the second strap 57 can be adjusted to thereby allow the mounting means 47 to be securely attached to the portable massaging machine M. The plate 48, first strap 49 and second strap 57 may be cut and bent out of sheet metal or the like, or otherwise constructed, as will now be apparent to those skilled in the art. The plate 48 is preferably securely attached to the first strap 49 in any manner now apparent to those skilled in the art such as with one or more rivets 68 or the like.

The apparatus 11 preferably includes attachment means 69 for attaching the body member 25 to a support member such as the chair C. The attachment means 69 may include one or more elastic cords 71 for extending from the body member 25, around a portion of the back portion 23 of the chair C, and back to the body member 25 to thereby securely attach the body member 25 to the back portion 23 of the chair C. More specifically, each elastic cord 71 preferably has a first end 73 with a hook 75 thereon for hooking into one of the apertures 43 through one side of the base member 32, and a second end 77 with a hook 79 thereon for hooking into one of the apertures 43 through the other side of the base member 32 as clearly shown in FIG. 4. Each elastic cord 71 may be adjustable in length for accommodating back portions 23 of different dimensions, etc. For example, the hook 75 of the first end 73 of each elastic cord 71 may be slidably attached to the body of the elastic cord 71 to allow the effective length of the elastic cord 71 to be varied as will now be apparent to those skilled in the art. The elastic cords 71 may be constructed in various manners, out of various materials, in various ornamental designs, and in various sizes. Each elastic cord 71 is preferably a typical off-the-shelf product as will now be apparent to those skilled in the art.

Figure 6:
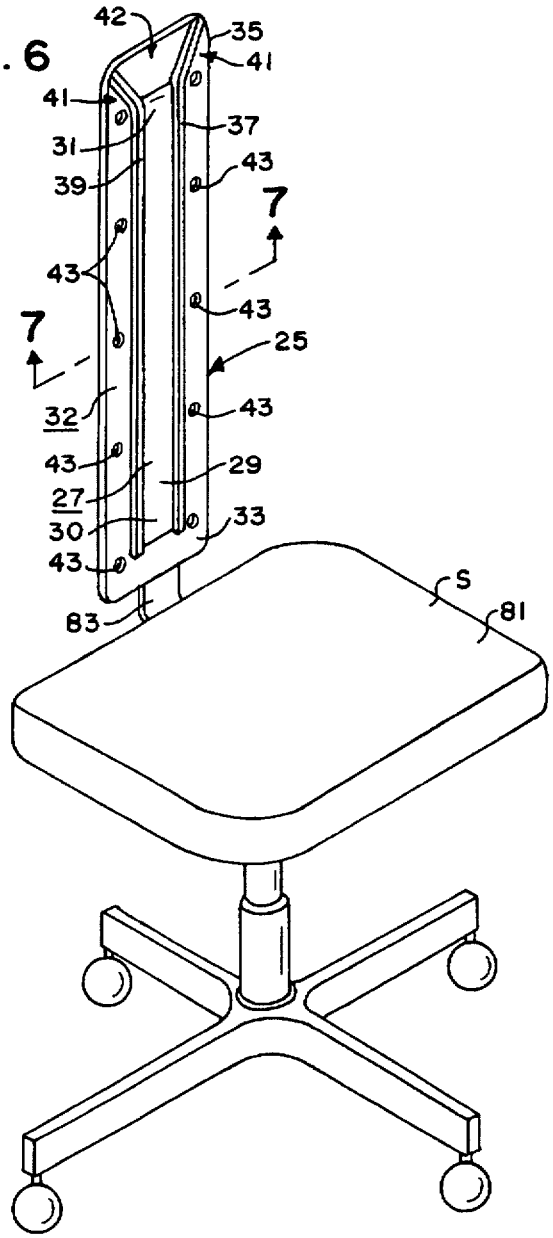
FIG. 6 is a perspective view of a part of the present invention, shown combined with a chair not having a standard backrest portion.
Figure 7:
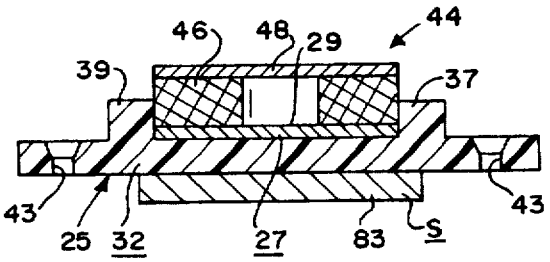
FIG. 7 is a sectional view substantially as taken on line 7—7 of FIG. 6 on an enlarged scale, shown combined with additional parts of the present invention.
Figure 8:
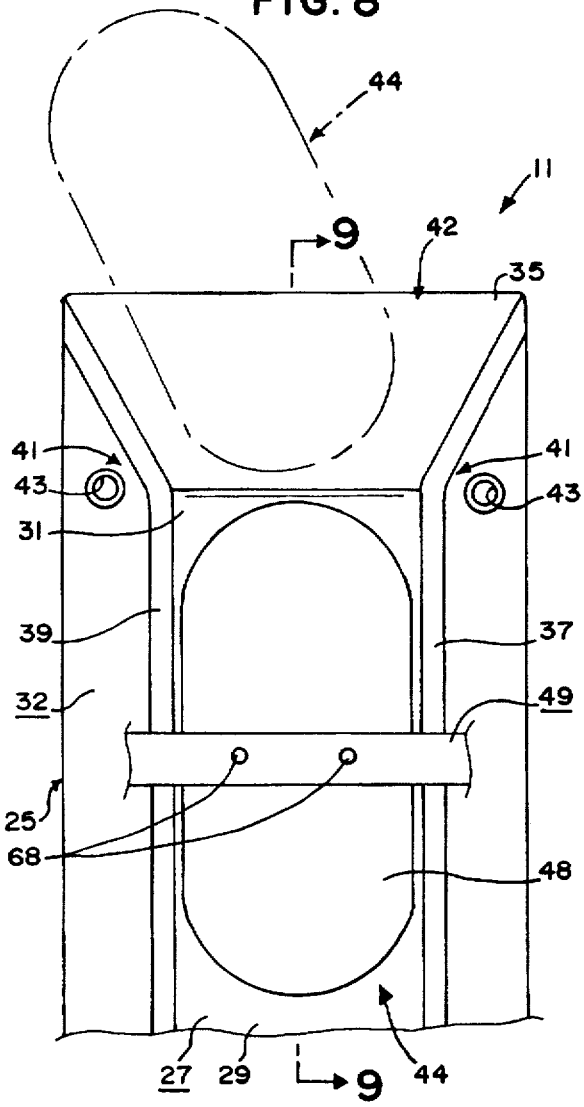
FIG. 8 is a somewhat diagrammatic elevational view of portions of the present invention, with part thereof shown in a moved position in broken lines.
Figure 9:
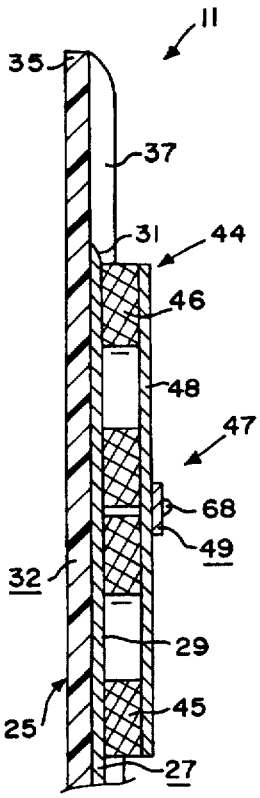
FIG. 9 is a sectional view substantially as taken on line 9—9 of FIG. 8.

On the other hand, the attachment means may consist of glue, screws, bolts, etc., for securely attaching the body member 25 to a support member. More specifically, as shown in FIGS. 6 and 7, the support member may consist of a typical secretarial-type chair S having a seat portion 81 with a relatively rigid spine or elongated bar 83 extending upward from the back of the seat portion 81 to which a relatively small backrest portion is typically slidably mounted. However, the backrest portion can be removed and the body member 25 may be attached to the bar 83 by merely gluing or screwing the base member 32 thereto in a substantially upright position as shown in FIGS. 6 and 7 and as will now be apparent to those skilled in the art. Alternatively, it should be noted that the bar 83 may be a replacement item for replacing the entire back portion of a typical secretarial-type chair and provided as part of the present invention.

The operation and use of the apparatus 11 of the present invention is quite simple. The first step may be to attach the body member 25 to the desired support member. For example, to attach the body member 25 to the chair C, one or more elastic cords 71 are typically used to extend from one edge or side of the base member 32, around the rear of the back portion 23 of the chair C, and to the other edge or side of the base member 32 to securely attach the body member 25 to the chair C, normally in a substantially upright or vertical position. The next step may be to attach the magnetic means 44 to the portable massaging machine M. For example, the mounting means 47 may be buckled to the handles 15 of the housing 13 of the portable massaging machine M to position the first and second magnets 45, 46 on the back surface 16 of housing 13 of the portable massaging machine M as clearly shown in FIG. 5 and as will now be apparent to those skilled in the art. Next, the combined portable massaging machine M and magnetic means 44 is attached to the body member 25 by merely bringing the first and second magnets 45, 46 into contact with the face surface 29 of the magnetic portion 27 of the body member 25 as shown in FIGS. 4, 5, and 7–9. The mouth 42 formed by the diverging tracks 37, 39 at the second or upper end 35 of the base member 32, combined with the bevel on the second or upper end 31 of the magnetic portion 27 and the omission of the magnetic portion 27 at the second or upper end 35 of the base member 32 allows the magnetic means 44 to be easily brought into contact and aligned with, and subsequently removed from, the magnetic portion 27 as will now be apparent to those skilled in the art. The combined portable massaging machine M and magnetic means 44 can then be easily moved up and down on the magnetic portion 27 to position the massaging fingers 19 of the portable massaging machine M at any desired location, depending on the height of the user, the specific area of the user's back it is desired to massage, etc.

If treatment is desired for problems in the thigh and leg areas, the massaging action can be applied to the lower lumbar vertebrae housing the nerves which supply these areas. Similarly, by raising the position of the machine to a higher level, it will massage vertebrae which house nerves supplying abdominal, thoracic or neck areas.

Figure 10:
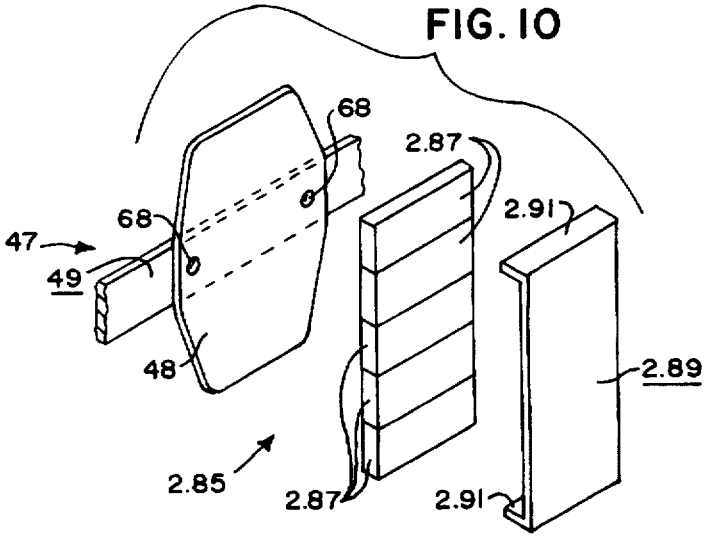
FIG. 10 is an exploded perspective view of an alternate embodiment of the magnetic means of the apparatus of the present invention.
Figure 11:
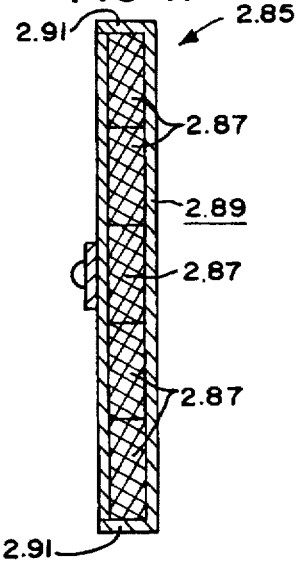
FIG. 11 is a sectional view of the alternate embodiment of the magnetic means of FIG. 10.

An alternate embodiment of the magnetic means is shown in FIGS. 10 and 11, and identified by the numeral 2.85. The magnetic means 2.85 preferably includes a plurality of off-the-shelf bar-type ceramic magnets 2.87 and a metal plate 2.89 for covering the face of each magnet 2.87 (i.e., the side of each magnet 2.87 for being positioned against and attracted to the magnetic portion 27) so that the metal plate 2.89 will protect and reduce wear, etc., of the face of each magnet 2.87 as will now be apparent to those skilled in the art. Each end of the metal plate 2.89 preferably has a flange 2.91 for extending over a portion of each end of the combined group of magnets 2.87 as clearly shown in FIG. 11 to more securely hold the magnets 2.87 together and to the metal plate 2.89. Appropriate cement or the like (not shown) is preferably provided between each flange 2.91 and the adjacent portion of the plurality of magnets 2.87 to fixedly secure the magnets 2.87 and the metal plate 2.89 together. The mounting means 47 can also be used for mounting the magnetic means 2.85 to the portable massaging machine M.

More specifically, the back of each magnet 2.87 can be attached to the plate 48 of the mounting means 47 for the same reasons and in the same manner as hereinabove disclosed relative to the magnets 45, 46 (e.g., the back of each magnet 2.87 may be cemented or otherwise fixedly attached to the plate 48). It should be noted that the shape of the plate 48 can be modified to conform more closely to the combined shape of the magnets 2.87 as clearly shown in FIG. 10.

Although the present invention has been described and illustrated with respect to a preferred embodiment and preferred uses therefor, it is not to be so limited since modifications and changes can be made therein which are within the full intended scope of the invention.

We claim:

1. In combination, a portable massaging machine, and an apparatus for mounting said portable massaging machine to a support member; said apparatus comprising:

(a) a backboard member for attachment to the support member; said backboard member including a magnetic member; said backboard member including a base member having a face surface and a pair of spaced apart ridge members on said face surface; and (b) securing means for adjustably securing the portable massaging machine to said backboard member; said securing means including a magnet for movable attachment to said magnetic member of said backboard member.

2. The apparatus of claim 1 in which each of said ridge members of said base member has a first end and a second end; and in which said ridge members are parallel to one another from said first ends thereof to a point intermediate said first and second ends thereof and diverge from one another from said point intermediate said first and second ends thereof to said second ends thereof.

3. The apparatus of claim 2 in which said magnetic member is attached to said face surface of said base member between said ridge members; and in which said magnetic member has a first end located substantially adjacent said first end of said ridge members, and a second end located substantially adjacent said point intermediate said first and second ends of said ridge members.

4. The apparatus of claim 3 in which said second end of said magnetic member is bevelled.

5. An apparatus for mounting a portable massaging machine to a chair; said apparatus comprising:

(a) a non-magnetic base member for attachment to the chair; said base member having a face surface, a first end, a second end, a first side, a second side, a first ridge member extending outward from said face surface thereof and extending between said first and second ends thereof adjacent said first side thereof, a second ridge member extending outward from said face surface thereof parallel to and spaced from said first ridge member and extending between said first and second ends thereof adjacent said second side thereof;

(b) a magnetic member attached to said face surface of said base member between said first and second ridge members;

(c) a magnet for movable and removable attachment to said magnetic member; said magnet having a shape which allows said magnet to be positioned between said first and second ridge members of said base member and moved between said first and second ends of said base member while preventing said magnet from being rotated about an axis perpendicular to said face surface of said base member; and (c) mounting means for mounting said magnet to the portable massaging machine.

6. The apparatus of claim 5 in which said mounting means includes a first strap and a second strap; said first strap having a first end attached to said magnet and having a second end; said second end of said first strap having a hook for hooking onto a portion of the portable massaging machine; said second strap having a first end attached to said magnet and having a second end; said second end of said second strap having a hook for hooking onto a portion of the portable massaging machine; said mounting means including adjustment means for adjusting the distance between said second end of said first strap and said second end of said second strap.

7. The apparatus of claim 6 in which the chair has a backrest portion; and in which is included attachment means for attaching said base member to the backrest portion of the chair.

8. The apparatus of claim 5 in which said attachment means includes one or more elastic cords for extending from said base member, around a portion of the backrest portion of the chair, and back to said base member.

9. The apparatus of claim 8 in which said one or more elastic cords are adjustable in length.

10. In combination, a portable massaging machine;

a body having a magnetic member; and securing means for adjustably securing said portable massaging machine to said body;

said securing means including magnetic means for attachment to said portable massaging machine and for movably attaching said portable massaging machine to said magnetic member of said body; and said portable massaging machine including massaging fingers for kneading a portion of a person's body.

11. In combination, a portable massaging machine;

a body having a magnetic member; and securing means for adjustably securing said portable massaging machine to said body;

said securing means including magnetic means for attachment to said portable massaging machine and for movably attaching said portable massaging machine to said magnetic member of said body; and said portable massaging machine including massaging fingers for vibrating a portion of a person's body.

* * * * *